US005973268A

United States Patent [19]

Cheng

[11] Patent Number: 5,973,268

[45] Date of Patent: Oct. 26, 1999

[54] MULTICOLOR ELECTRIC CABLE

[76] Inventor: Yu-Feng Cheng, No. 7, Fuhsing St., Tucheng Ind. Dist., Tucheng City, Taipei Hsien, Taiwan

[21] Appl. No.: 08/987,656

[22] Filed: Dec. 9, 1997

[51] Int. Cl.[6] ..... H01B 7/08

[52] U.S. Cl. ..... 174/112; 174/117 F

[58] Field of Search ..... 174/112, 117 F

[56] References Cited

U.S. PATENT DOCUMENTS

| | | | |
|---|---|---|---|
| 2,420,221 | 5/1947 | Bell | 174/112 X |
| 2,438,006 | 3/1948 | Gustafson | 174/112 X |
| 2,628,998 | 2/1953 | Frisbie | 174/112 |
| 2,916,055 | 12/1959 | Brumbach | 174/112 X |
| 3,736,366 | 5/1973 | Wittenberg | 174/112 X |
| 3,756,447 | 9/1973 | Hadfield | 220/3.3 |
| 4,300,284 | 11/1981 | Reeder | 174/112 X |
| 4,543,448 | 9/1985 | Deurloo | 174/112 |
| 5,132,489 | 7/1992 | Yamano | 174/112 X |
| 5,296,648 | 3/1994 | Johnson | 174/117 F |
| 5,342,991 | 8/1994 | Xu et al. | 174/117 F X |

*Primary Examiner*—Dean A. Reichard
*Attorney, Agent, or Firm*—Kirkpatrick & Lockhart LLP

[57] ABSTRACT

A multicolor electric cable includes a plurality of core wires respectively having a PVC coating layer disposed at an outer periphery thereof. The PVC coating layers each have a color different to the other layers. A corresponding number of transparent PVC layers respectively covers around each PVC coating layer for a user to identify individual wires, wherein adjacent transparent PVC layers have a connection formed therebetween.

1 Claim, 3 Drawing Sheets

MULTICOLOR ELECTRIC CABLE

BACKGROUND OF THE INVENTION

1. Field of the Invention

The present invention relates to a multicolor electric cable, and more particularly to an electric cable with several colors from which a user can easily identify different wires received therein, and to an electric cable which has a strong structure and an attractive appearance.

2. Description of Related Art

A conventional electric cable typically has received therein a plurality of wires with the same color. To identify the different wires, a corresponding number of adapters with different colors are generally and respectively connected to each wire, which is quite dull and a user needs to check each head of the adapter to identify the usage thereof. Referring to FIG. 4, there is shown the structure of a conventional electric cable. The conventional electric cable contains a plurality of wires 60 each of which is simply and only a conducting material, such as strands of copper. Each wire 60 is coated with a red (not shown) PVC layer 61. Adjacent PVC layers 61 have a connection 62 formed therebetween. For identification purposes, one of the adjacent PVC layers 61 is covered by an additional PVC layer 63 with a color different from red. This conventional electric cable has a disadvantage that the connection 62 is not smooth in its appearance, because it is formed by extrusion. A second disadvantage is that the electric cable has a dull coloring. This is because the working process thereof needs a long time to achieve what is required, and the manufacture thereof also needs a lot of working process, which is not economical. Another conventional electric cable has a structure as shown in FIG. 5. The electric cable includes a plurality of wires 64 coated with a corresponding number of PVC layers 65 with different colors. Adjacent PVC layers 65 are connected in a manner of ultrasonic thermal treatment. Though a user can easily identify different wires according to the multicolor PVC layers 65, this conventional electric cable has disadvantages that the connection between adjacent PVC layers 65 may be damaged due to the manufacturing processes, such as the long heating time, or by external force, and this kind of electric cable can only be manufactured in short length, which is not suitable for practical requirements.

The present invention provides an improved multicolor electric cable to mitigate and/or obviate the aforementioned problems.

SUMMARY OF THE INVENTION

One object of the present invention is to provide an electric cable with several colors from which a user can easily identify different wires received therein.

Another object of the present invention is to provide a multicolor electric cable which is adapted for mass production.

A further object of the present invention is to provide a multicolor electric cable which has a strong structure and an attractive appearance.

Other objects, advantages and novel features of the invention will become more apparent from the following detailed description when taken in conjunction with the accompanying drawings.

DETAILED DESCRIPTION OF PREFERRED EMBODIMENT

Figure 1:
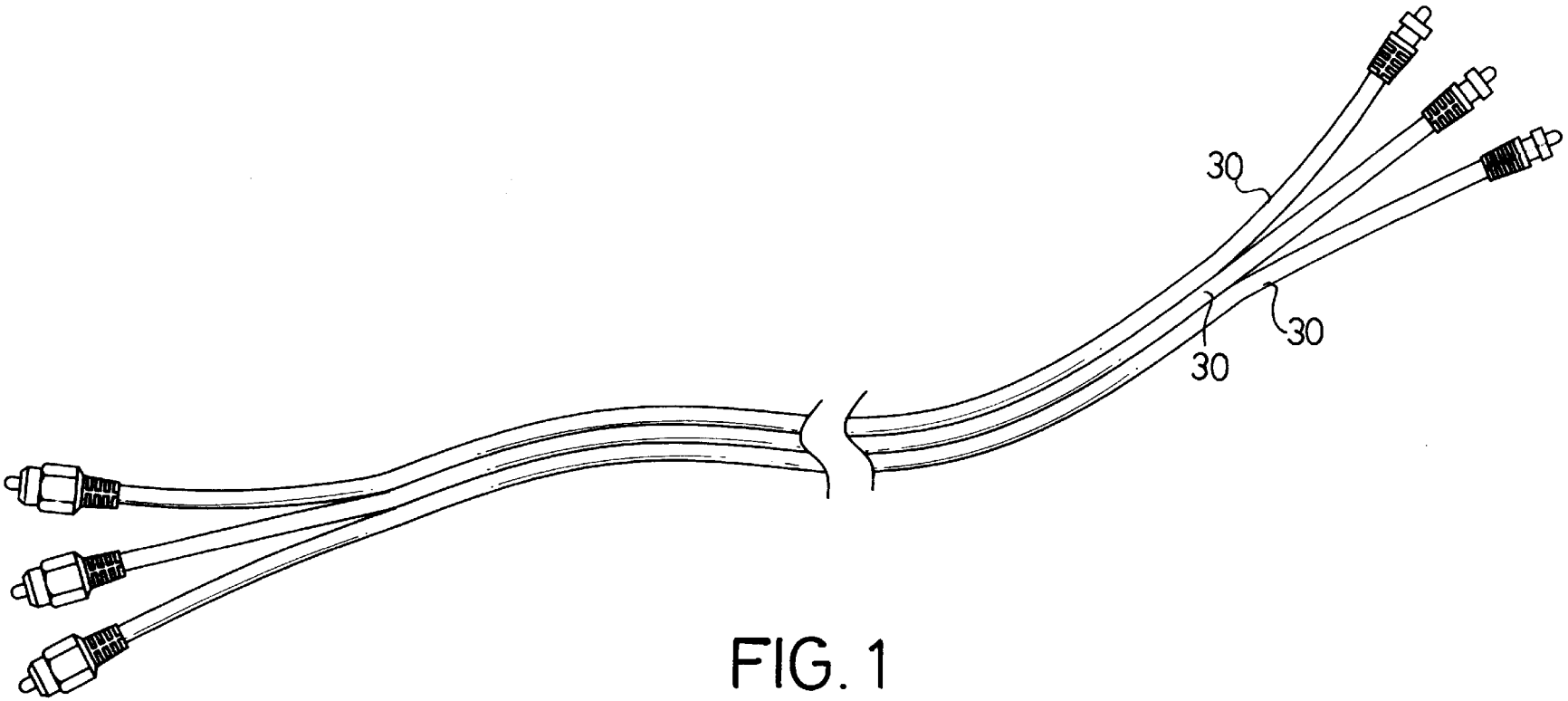
FIG. 1 is a perspective view showing a plurality of wires of the multicolor electric cable in accordance with the present invention.
Figure 3:
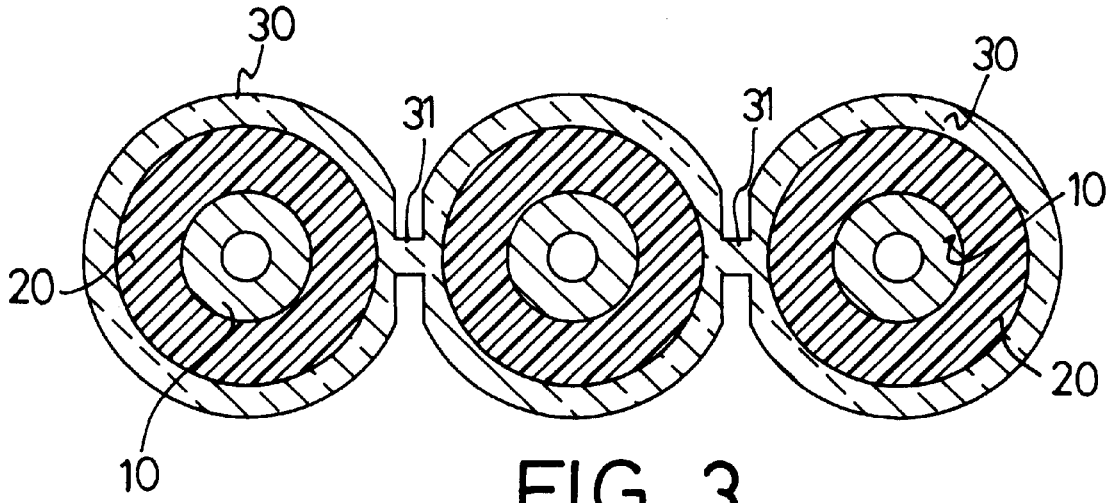
FIG. 3 is a cross sectional view showing the electric cable in accordance with the present invention.
Figure 4:
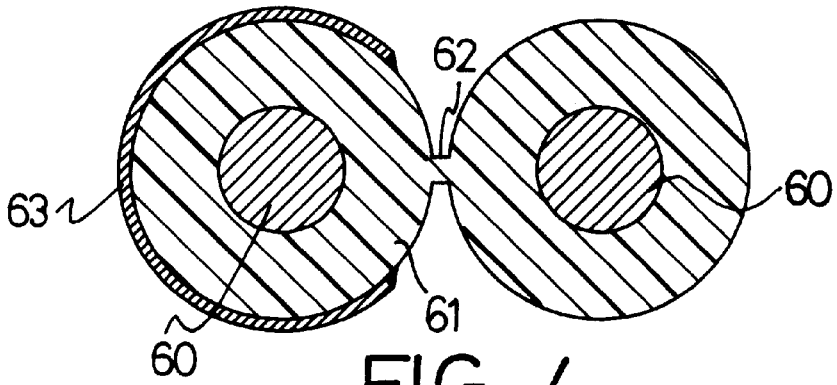
FIG. 4 PRIOR ART
FIG. 4 is a cross sectional view showing a conventional electric cable.
Figure 5:
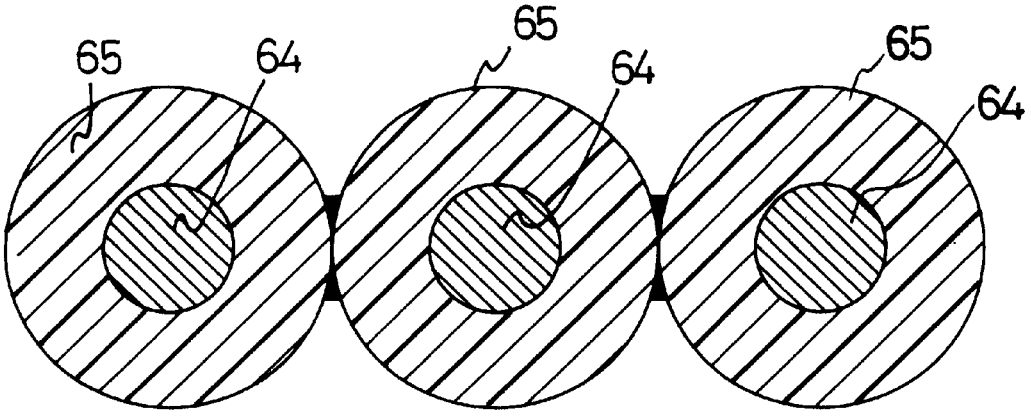
FIG. 5 PRIOR ART
FIG. 5 is a cross sectional view showing another conventional electric cable.

Referring to FIG. 1 and FIG. 3, a multicolor electric cable in accordance with the present invention includes a plurality of wires (not numbered) each having a metal core 10 received therein. A plurality of PVC coating layers 20 are respectively disposed at outer peripheries of the wires. Each of the plurality of PVC coating layers 20 has a color different to the other PVC coating layers. In addition, a corresponding number of transparent PVC layers 30 are respectively covered around each PVC coating layer 20. Adjacent transparent PVC layers 30 have a connection 31 formed therebetween. From the transparent PVC layers 30, a user can easily identify different wires according to different colors of the PVC coating layers 20.

Figure 2:
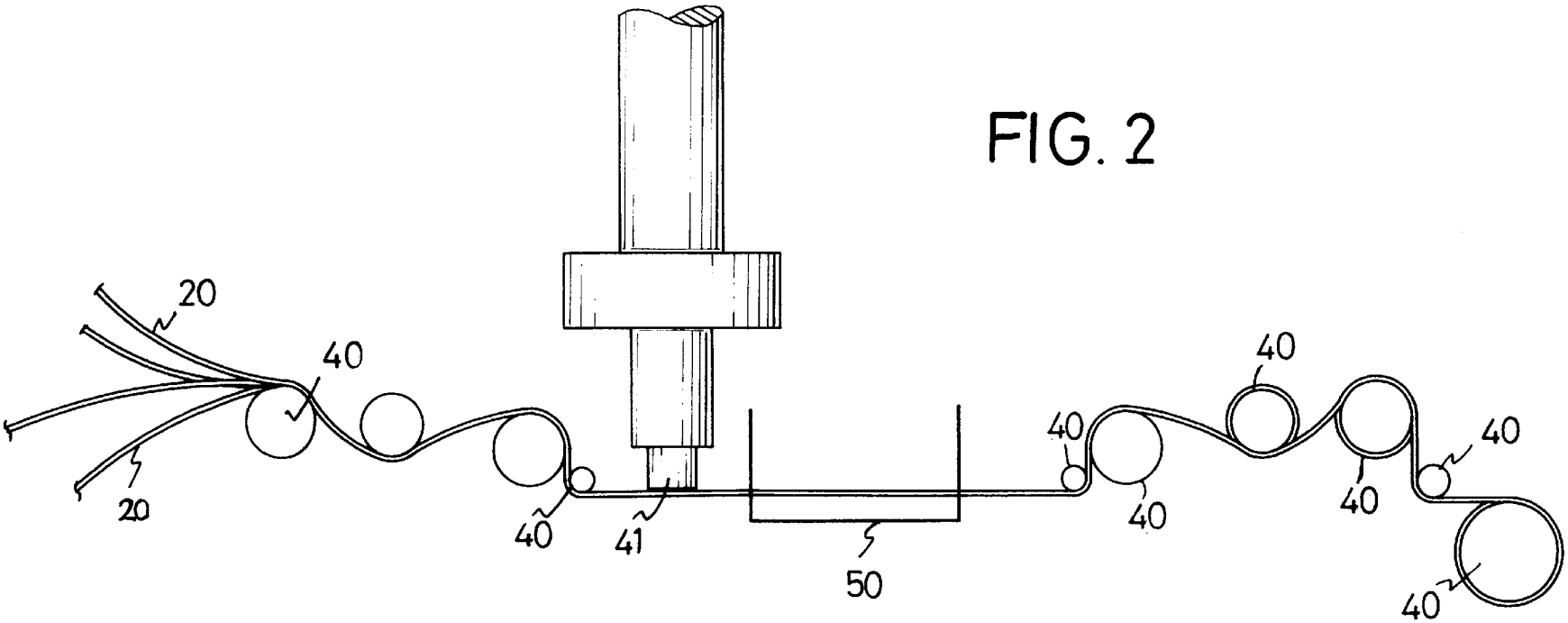
FIG. 2 is a schematic view showing a process of manufacture of the multicolor electric cable in accordance with the present invention.

Referring to FIG. 2 and FIG. 3, in a manufacturing process, each of the wires are initially and individually coated with a PVC coating layers 20 of one color. Then a plurality of rollers 40 are used to deliver the wires to a mold 41, thereby maintaining elasticity of the wires. Thereafter, the transparent PVC material is implanted into the mold 41 from a top face thereof and is formed to a transparent PVC layer around the PVC coating layer 20 by the mold 41. Finally, the resultant wires are cooled by a water bath 50 and collected via other rollers 40. Since the multicolor electric cable in accordance with the present invention can be produced by molding much faster than by a thermal treatment, it is adapted for mass production. Further, the PVC layers 30 of the electric cable are integrally formed by molding, so that they are stronger than those of the conventional electric cable which is produced by thermal treatment. Additionally, the electric cable manufactured in such a way has an attractive appearance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multicolor electrical cable comprising:

a plurality of core wires each having a PVC coating layer coated on an outer periphery thereof, each of said PVC coating layers being of a color different from the other PVC coating layers; and a corresponding number of transparent molded PVC layers each integrally mounted around one of said PVC coating layers, wherein adjacent transparent PVC layers have a connection integrally formed therebetween, whereby said connection has a reinforcing strength.

* * * * *